US011066845B2

(12) United States Patent
Beagen et al.

(10) Patent No.: US 11,066,845 B2
(45) Date of Patent: Jul. 20, 2021

(54) RAZOR WIRE BARRIER FOR ACCESS POINT SECURITY

(71) Applicant: ALLIED TUBE & CONDUIT CORPORATION, Harvey, IL (US)

(72) Inventors: Joseph Beagen, North Attleboro, MA (US); William Tyler Howe, Worcester, MA (US); Carmen Samara, Homer Glen, IL (US)

(73) Assignee: Allied Tube & Conduit Corporation, Harvey, IL (US)

( * ) Notice: Subject to any disclaimer, the term of this patent is extended or adjusted under 35 U.S.C. 154(b) by 648 days.

(21) Appl. No.: 15/865,672

(22) Filed: Jan. 9, 2018

(65) Prior Publication Data

US 2019/0211578 A1 Jul. 11, 2019

(51) Int. Cl.
*E04H 17/16* (2006.01)
*E04H 17/00* (2006.01)
(Continued)

(52) U.S. Cl.
CPC ..... *E04H 17/003* (2013.01); *E04H 17/161* (2013.01); *E04H 17/18* (2013.01); *F41H 11/08* (2013.01)

(58) Field of Classification Search
CPC ..... B65D 19/10; B65D 19/12; B65D 90/006; B65D 2519/00164; B65D 2519/00298;
(Continued)

(56) References Cited

U.S. PATENT DOCUMENTS 191,913 A 6/1877 Barnes
2,780,383 A * 2/1957 Coit, Jr. ..... B65D 19/10 220/7
(Continued)

FOREIGN PATENT DOCUMENTS

AU 2006100083 A4 3/2006
EP 0286271 A2 10/1988
(Continued)

OTHER PUBLICATIONS

Extended European Search Report for application No. 19150791.2, dated Jun. 13, 2019, 7 pages.

*Primary Examiner* — Michael P Ferguson
(74) *Attorney, Agent, or Firm* — Kacvinsky Daisak Bluni, PLLC

(57) ABSTRACT

A razor wire barrier is disclosed. In some embodiments, the razor wire barrier includes a frame including a floor and a plurality of walls defining an interior area. The razor wire barrier may further include a first section of razor wire within the interior area, and a component receptacle extending along the floor, adjacent the first section of razor wire. The component receptacle is operable to receive a component of a machine for moving the frame. In some embodiments, the component receptacle is a hollow member operable to receive a forklift prong. In some embodiments, the razor wire barrier may further include a second section of razor extending along the plurality of walls. In some embodiments, the first section of razor wire includes one or more coils of concertina razor wire, and the second section of razor wire includes one or more panels of razor wire.

7 Claims, 5 Drawing Sheets

(51) Int. Cl.
*F41H 11/08* (2006.01)
*E04H 17/18* (2006.01)

(58) Field of Classification Search
CPC ..... E04H 17/04; E04H 17/16; E04H 17/161; E04H 17/163
See application file for complete search history.

(56) References Cited

U.S. PATENT DOCUMENTS 3,070,946 A 1/1963 Kirsch et al.
3,217,965 A 11/1965 Macie
3,979,006 A * 9/1976 Jurasek ..... B65D 7/20 220/485
4,629,086 A * 12/1986 Trubiano ..... B65D 19/12 220/489
5,036,979 A 8/1991 Selz
5,072,980 A 12/1991 Mainiero
D331,306 S * 11/1992 Sumpter ..... D3/272
5,401,002 A * 3/1995 Major ..... B21F 25/00 256/2
6,170,686 B1 * 1/2001 Flores ..... B65D 7/24 220/4.33
7,325,787 B1 2/2008 Gibbs
9,452,881 B2 * 9/2016 Skeid ..... B65D 90/008
D859,832 S * 9/2019 Bokros ..... D3/272
2006/0214148 A1 9/2006 Major et al.
2007/0138454 A1 * 6/2007 Yeo ..... E04H 17/04 256/2
2008/0193247 A1 * 8/2008 Zupancich ..... B65D 19/10 410/92
2009/0001335 A1 1/2009 Wilson
2009/0032791 A1 2/2009 Saura Sotillos
2009/0241809 A1 * 10/2009 Head ..... B66C 1/10 108/55.1
2009/0272738 A1 11/2009 Marcel
2012/0152946 A1 * 6/2012 Gronholm ..... B65D 19/12 220/6

FOREIGN PATENT DOCUMENTS

EP 2068324 A2 6/2009
EP 2 562 094 * 2/2013 ..... B65D 19/18
FR 3 045 016 * 6/2017 ..... B65D 19/36
GB 1221178 A 2/1971
WO 20150154103 A1 10/2015

* cited by examiner

RAZOR WIRE BARRIER FOR ACCESS POINT SECURITY

BACKGROUND OF THE DISCLOSURE

Field of the Disclosure

The present disclosure relates access point security and, more particularly, to a razor wire barrier for access point security.

Discussion of Related Art

Many barriers exist for providing a deterrent to ingress into and/or egress from a secured area. One known apparatus is a barbed or razor wire fence comprised of a plurality of strands of spaced wires supported by a plurality of horizontally spaced posts. Another known apparatus is a mesh wire fence, which may also be supported by a plurality of horizontally spaced posts. Each apparatus may also be topped by a plurality of strands of barbed/razor wire inclined at an angle towards the outside of the secured area and, in some instances, a plurality of strands of barbed/razor wire inclined at an angle towards the inside of the secured area. Such angularly oriented strands of barbed/razor wire are provided for preventing a human from climbing the security fence and then climbing upwardly over the top of the security fence. In other known apparatuses, one or more layers of concertina razor wire may be coupled to a fence.

Furthermore, transportable or movable barriers for defining a confined or protected area, and which can be rapidly deployed, are well known. Typically, such barriers include one or more concertina coils which are stored in a compressed fashion and axially extended to deploy. The concertina coils may be constructed from a variety of diameters and include a variety of barbed configurations.

One problem associated with known moveable/deployable barriers is that during and/or after deployment, the barrier becomes misaligned and does not attain or retain a desired deployed configuration. For example, during and/or after deployment, the barrier may be overextended or underextended, causing the concertina coils to sag or become misaligned. As a result of such misalignment, the effectiveness of the barrier is reduced.

Furthermore, it has been found that access points such as a gate are often a weak point of a secure perimeter. Firstly, the exposed post(s) create climbing points. Secondly, the razor wire extending around the gate has a gap to allow the gate to open and close. In an effort to minimize the gap between the gate and the razor wire, the two are often placed in close proximity. However, the razor wire may get tangled, causing issues opening and closing the gate.

SUMMARY OF THE DISCLOSURE

In view of the foregoing, there is a need in the art for razor wire barrier for an access point, which provides increased security while still allowing passage though the access point.

In one or more embodiments, a razor wire barrier may include a frame having a floor and a plurality of walls defining an interior area, and a first section of razor wire within the interior area. The razor wire barrier may further include a component receptacle extending along the floor, adjacent the first section of razor wire, the component receptacle operable to receive a component of a machine for moving the frame.

In one or more embodiments, a razor wire barrier for access point security may include a frame including a floor and a plurality of side walls defining an interior area. The razor wire barrier may further include a first section of razor wire disposed within the interior area, and a pair of component receptacles extending along the floor, beneath the first section of razor wire. The pair of component receptacles is operable to receive a component of a machine for moving the frame.

In one or more embodiments, a physical access point barrier may include a frame including a floor and a plurality of side walls defining an interior area. The physical access point barrier may further include a first section of razor wire disposed within the interior area, and a second section of razor wire extending along the plurality of side walls. The physical access point barrier may further include a pair of component receptacles extending along the floor, beneath the first section of razor wire, the pair of component receptacles operable to receive a component of a machine for moving the frame.

BRIEF DESCRIPTION OF THE DRAWINGS

The accompanying drawings illustrate exemplary approaches of the disclosure, including the practical application of the principles thereof, and in which.

Figure 1:
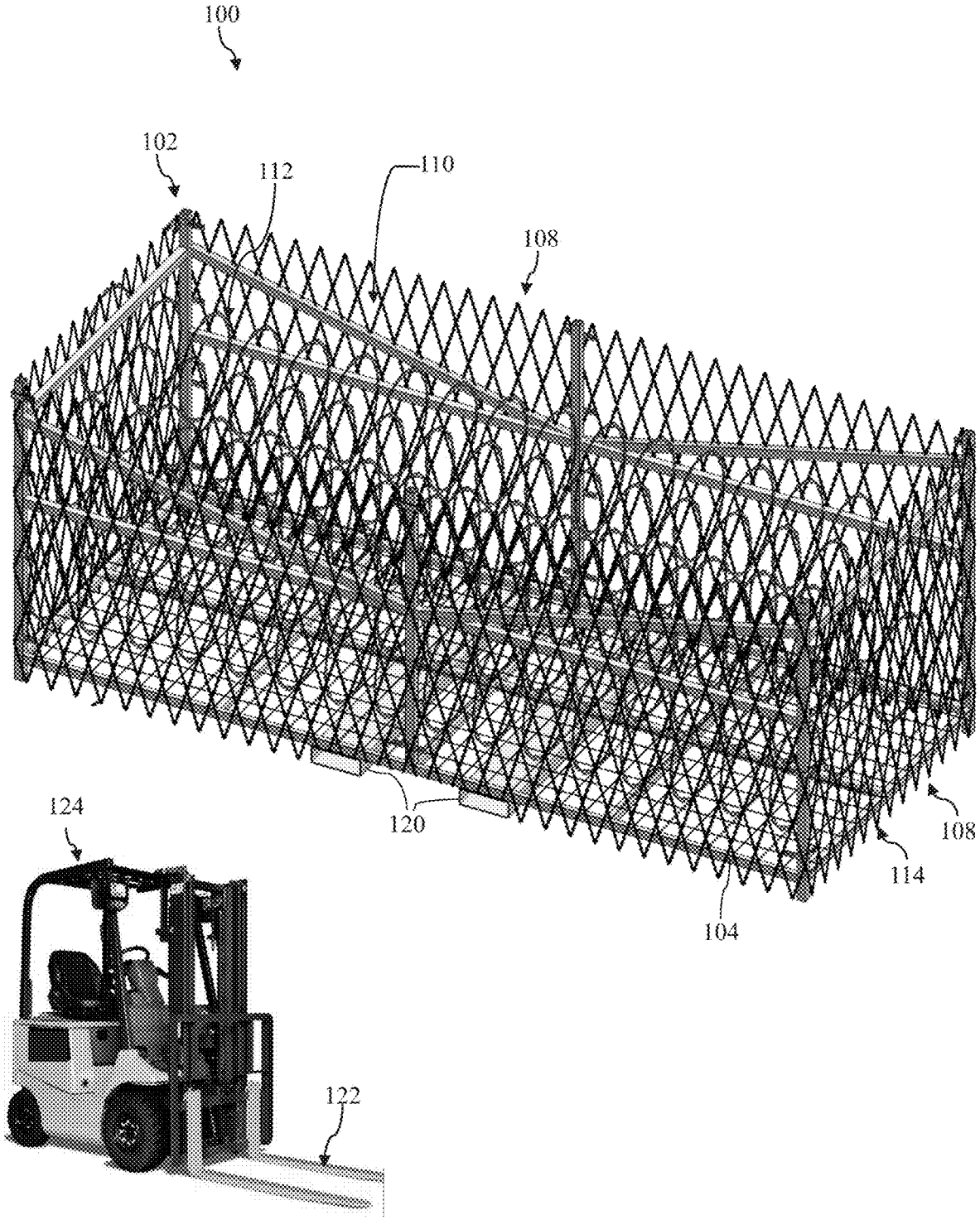
FIG. 1 is a perspective view of a razor wire barrier according to exemplary approaches of the disclosure.

The drawings are not necessarily to scale. The drawings are merely representations, not intended to portray specific parameters of the disclosure. Furthermore, the drawings are intended to depict exemplary embodiments of the disclosure, and therefore is not considered as limiting in scope.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

The present disclosure will now proceed with reference to the accompanying drawings, in which various approaches are shown. It will be appreciated, however, that the disclosed barrier may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

As will be further described herein, a razor wire barrier for an access point is disclosed. In some embodiments, the razor wire barrier includes a frame including a floor and a plurality of walls defining an interior area. The razor wire barrier may further include a first section of razor wire within the interior area, and a component receptacle extending along the floor, adjacent the first section of razor wire. The component receptacle is operable to receive a component of a machine for moving the frame. In some embodiments, the component receptacle is a hollow member operable to receive a forklift prong. In some embodiments, the razor wire barrier may further include a second section of razor extending along the plurality of walls. In some embodiments, the first section of razor wire includes one or more coils of concertina razor wire, and the second section of razor wire includes one or more panels or planar sections of razor wire. The embodiments herein disclose a barrier that provides razor barbed tape protection for increased security, while still allowing vehicles and persons to enter and exit, but with no additional points of climbing.

Figure 2:
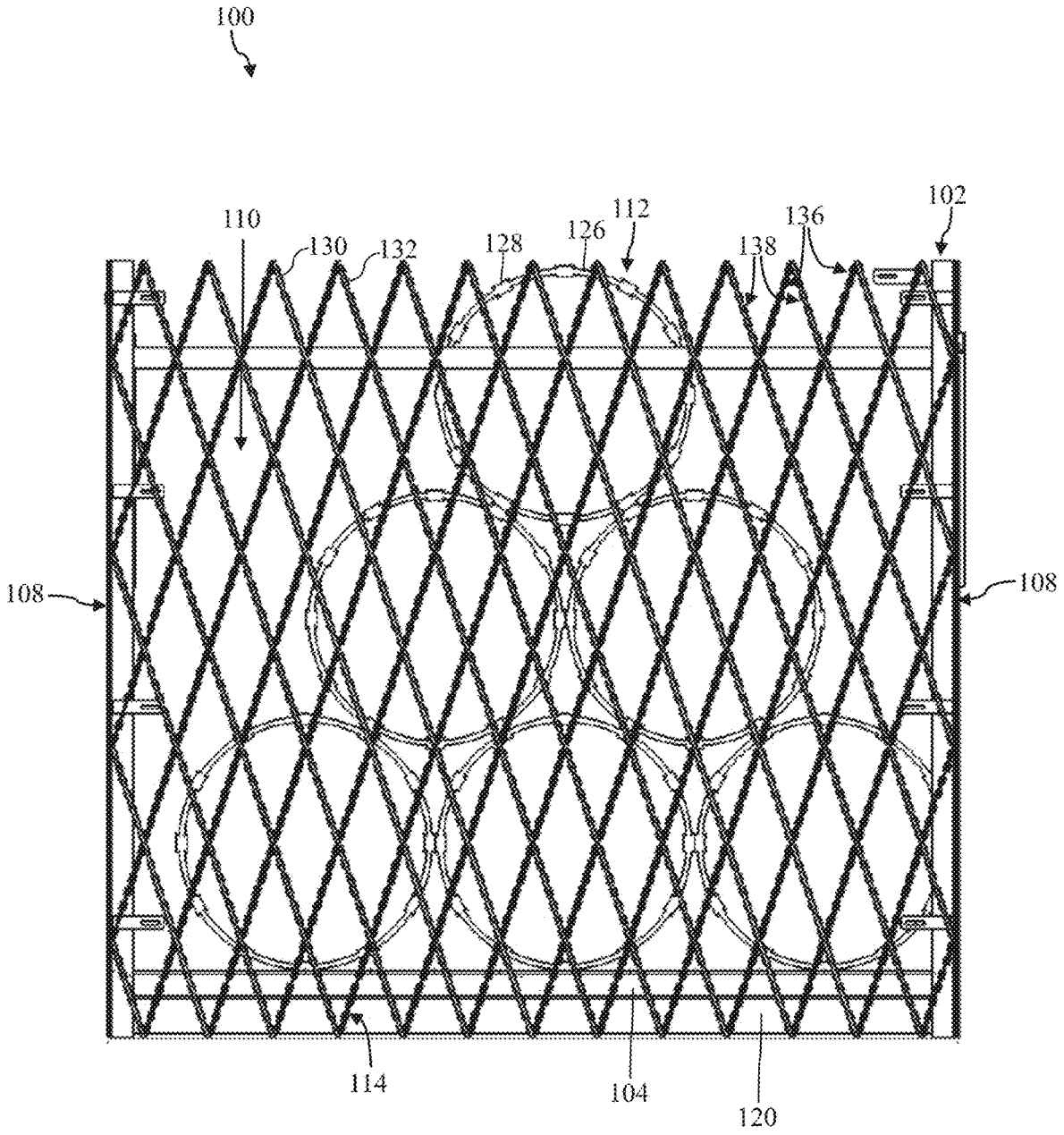
FIG. 2 is an end view of the razor wire barrier of FIG. 1 according to exemplary approaches of the disclosure.

Referring now to FIGS. 1-2, a razor wire barrier (hereinafter "barrier") 100 will be described in greater detail. As shown, the barrier 100 may include a frame 102 including a floor 104 and a plurality of side walls 108 extending from the floor 104. Together, the floor 104 and the plurality of side walls 108 may define an interior area 110, which may be open at the top. The barrier 100 may include a first section of razor wire 112, such as one or more coils of concertina or helical razor wire, within the interior area 110. The barrier 100 may further include a second section of razor wire 114, such as one or more planar sections of razor wire, extending along each of the plurality of side walls 108. As will be described in greater detail below, the barrier 100 may further include one or more component receptacles 120 operable to receive a component 122 (e.g., a fork prong) of a machine, such as a forklift 124. During use, the component receptacles 120 may be engaged by the forklift 124 to move the barrier 100 into and out of position relative to a physical access point (not shown), such as a gate, opening, doorway, etc.

As best shown in FIG. 2, in some embodiments, the first section of razor wire 112 (also known as razor ribbon, ribbon tape, or barbed tape), may include a central support section 126 and a set of barb clusters 128 extending from the central support section 126. The first section of razor wire 112 may be arranged in a concertina pattern whereby adjacent loops of helical coils are attached to one another at specified points on the circumference, as shown. In other embodiments, an elongated strip of metal corresponding to the central support section 126 may be bent slightly along its longitudinal axis in such a way that the strip substantially forms a helix. The concertina and helical structures are effective for preventing intrusions across the barrier 100 because barbs at the top of the first section of razor wire 112 extend directly toward a would-be intruder. In some non-limiting embodiments, each barb cluster may include four barbs, with a pair of barbs extending from each side of the central support section 126.

The non-limiting embodiment shown in FIGS. 1-2 may include six (6) coils of concertina razor wire arranged as a pyramid, the coils substantially covering an area of the floor 104. However, it'll be appreciated that a fewer or greater number of coils are within the scope of the present disclosure. A major axis of the circle or ellipse defined by each coil loop of the first section of razor wire 112 may extend in a generally parallel relationship to a plane defined by the floor 104. In some alternative embodiments, each coil loop of the first section of razor wire 112 may overlap an adjacent coil.

In some embodiments, the second section of razor wire 114 may include one or more panels of razor wire. As best shown in FIG. 2, the second section of razor wire 114 may similarly include a central support section 130 and a set of barb clusters 132 extending from the central support section 130. In some embodiments, the set of barb clusters 132 may be relatively smaller and spaced closer together than the barb clusters 128 of the first section of razor wire 112. Embodiments herein are not limited as such, however. The second section of razor wire 114 may be secured to the frame 102 by any means.

As further shown, the second section of razor wire 114 may be arranged as a mesh in which a first plurality of wire strands 136 is positioned across a second plurality of wire strands 138. In some embodiments, the first and second plurality of wire strands 136 and 138 may be interwoven. In other embodiments, the first plurality of wire strands 136 may not be interwoven with the second plurality of wire strands 138 and, instead, may be positioned directly adjacent one another. In yet other embodiments, the first and second plurality of wire strands 136 and 138 are integrally formed. Although shown in a crisscross diamond configuration, it'll be appreciated that the first and second plurality of wire strands 136 and 138 may also be oriented perpendicular to one another in other embodiments.

Figure 3:
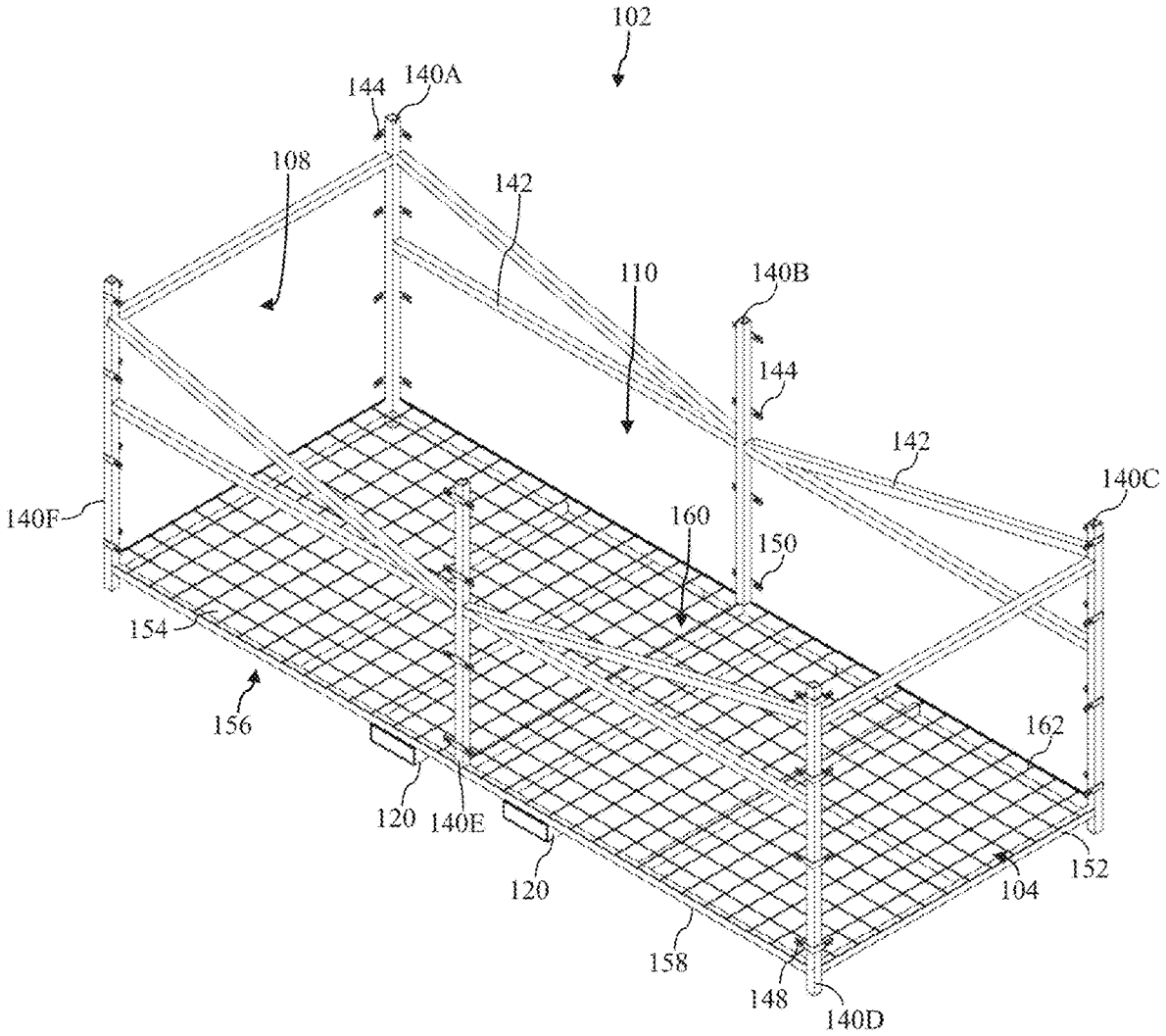
FIG. 3 is a perspective view of a frame of the razor wire barrier of FIG. 1 according to exemplary approaches of the disclosure.
Figure 4:
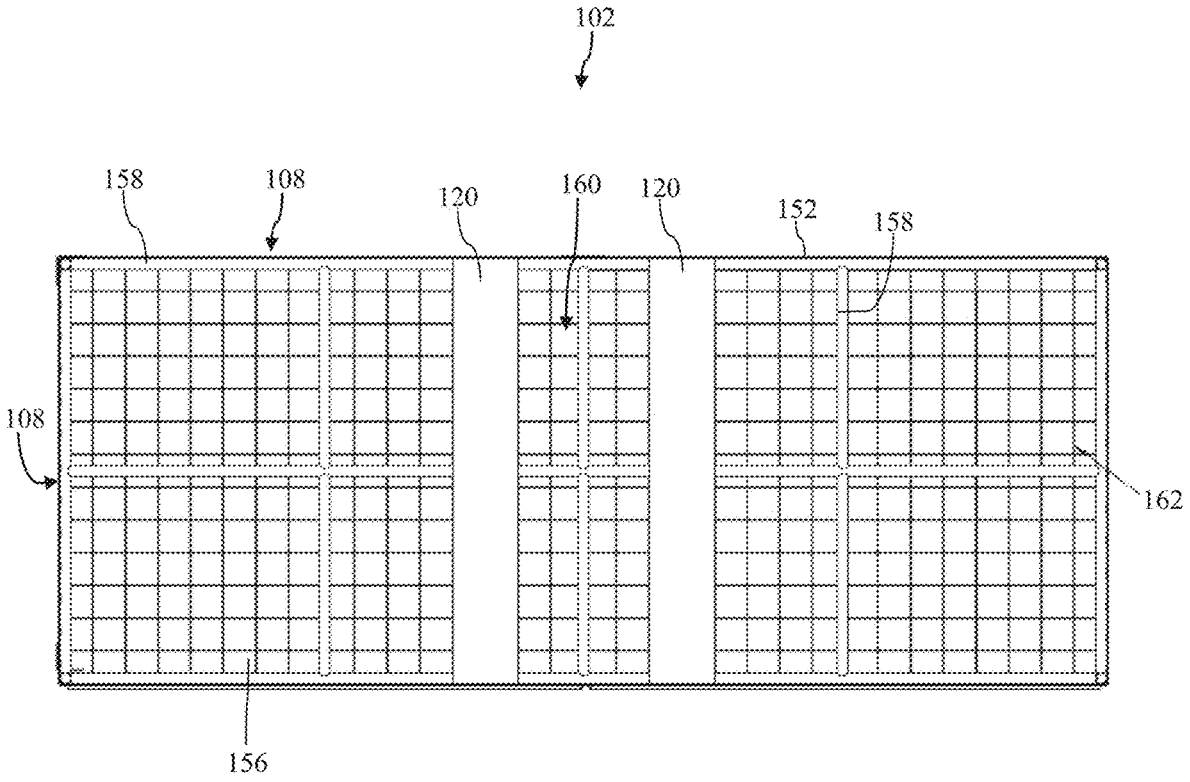
FIG. 4 is a bottom view of the frame of FIG. 3 according to exemplary approaches of the disclosure.

Referring now to FIGS. 3-4 the frame 102 of the barrier of FIGS. 1-2 according to embodiments of the present disclosure will be described in greater detail. As shown, the frame 102 may generally take on a rectangular or cuboid cage shape, including a plurality of perimeter posts 140A-F extending from the floor 104. Embodiments herein are not limited to any particular shape, however. For example, in other embodiments, the frame 102 may take on a square shape or a semicircular shape. As shown, each of the plurality of perimeter posts 140A-F may extend perpendicularly from the floor 104, thus defining each of the plurality of side walls 108. Extending between the plurality of perimeter posts 140A-F may be one or more cross posts 142. In some embodiments, one or more cross posts 142 may extend perpendicular to the perimeter posts 140A-F, and parallel to the floor 104. One or more other cross posts 142 are diagonally oriented with respect to the perimeter posts 140A-F and the floor 104 to provide stability to the perimeter posts 140A-F and therefore the side walls 108. In some embodiments, the plurality of posts 140A-F and the cross posts 142 are galvanized or stainless steel.

In a non-limiting embodiment, a height of each of the plurality of posts 140A-F, in an installed configuration, is preferably substantially in excess of the height of an average human. Furthermore, each of perimeter posts 140A, 140C, 140D, and 140F may extend below the floor 104, thus making contact with a ground surface. The floor 104 of the frame 102 may be raised from the ground surface to permit sufficient clearance for the component receptacles 120. In some embodiments, each of the perimeter posts 140B and 140E may not extend below the floor 104 so as to minimize potential interference between the fork of the forklift and the component receptacles 120.

As further shown, each of the plurality of perimeter posts 140A-F may include a fastener 144 coupled thereto. Although not limited to any particular shape or configuration, the fasteners 144 coupled to each of perimeter posts 140A, 140C, 140D, and 140F may each be an L-shaped bracket including a pair of openings 148 operable to receive a second fastener therethrough, such as a loop, clip, or hog ring-type fastener. The second fastener may couple together the second section of razor wire 114 and the L-shaped bracket. As further shown, the fasteners 144 coupled to each of the perimeter posts 140B and 140E may be a straight bracket, also including a pair of openings 150 for receiving the second fastener therethrough. In some embodiments, the first section of razor wire 112 may also be coupled to one or more of the perimeter posts 140A-F via the one or more fasteners 144.

The floor 104 of the frame 102 may include an outer perimeter 152, a first side 154, and a second side 156 opposite the first side 154. In some embodiments, the first side 154 of the floor 104 faces the interior area 110, while the second side 156 faces away from the interior area 110. As arranged, the first section of razor wire 112 (FIGS. 1-2) may be disposed directly atop the first side 154 of the floor 104. In some embodiments, the floor 104 includes a plurality of structural elements 158 for providing strength and rigidity to the floor 104. Although not limited to any particular shape or arrangement, the structural elements 158 may extend around the outer perimeter 152, as well as through a central area 160 of the floor 104, for example, in a windowpane pattern. In some embodiments, the structural elements 158 may be galvanized or stainless steel.

The floor 104 may further include a wire mesh fencing 162 extending between the structural elements 158. In some embodiments, the wire mesh fencing 162 may be coupled or welded to the structural elements 158 to provide a secure connection therebetween. The wire mesh fencing 162 may be a woven wire mesh having a square pattern, which is supported by the structural elements 158. The wire mesh fencing 162 is preferably formed from a strong and durable material, such as steel. The wire mesh fencing 162 may be sized and arranged so as to substantially cover the area of the floor 104 defined by the outer perimeter 152. In some embodiments, the first section of razor wire 112 may be coupled to the wire mesh fencing 162 and or the structural elements 158 using any variety of fasteners, ties, clasps, etc.

As better shown in FIG. 4, extending along the second side 156 of the floor 104 is the pair of component receptacles 120 in the central area 160 thereof. Each of the component receptacles 120 may be a hollow member extending parallel to one another. In some embodiments, the component receptacles 120 may extend substantially between opposite side walls 108 to enable access by the forklift from either side. The component receptacles 120 are preferably formed from a strong and durable material, such as steel, and may be coupled to the structural elements 158 of the floor 104, for example, by bolts or via welding. Although not limited to any particular shape or configuration, the component receptacles 120 are preferably dimensioned so as to accept a fork of a forklift therein. During use, the component receptacles 120 allow the barrier 100 to be lifted off of the ground surface and moved by the forklift when access through the physical access point is desired.

Figure 5:
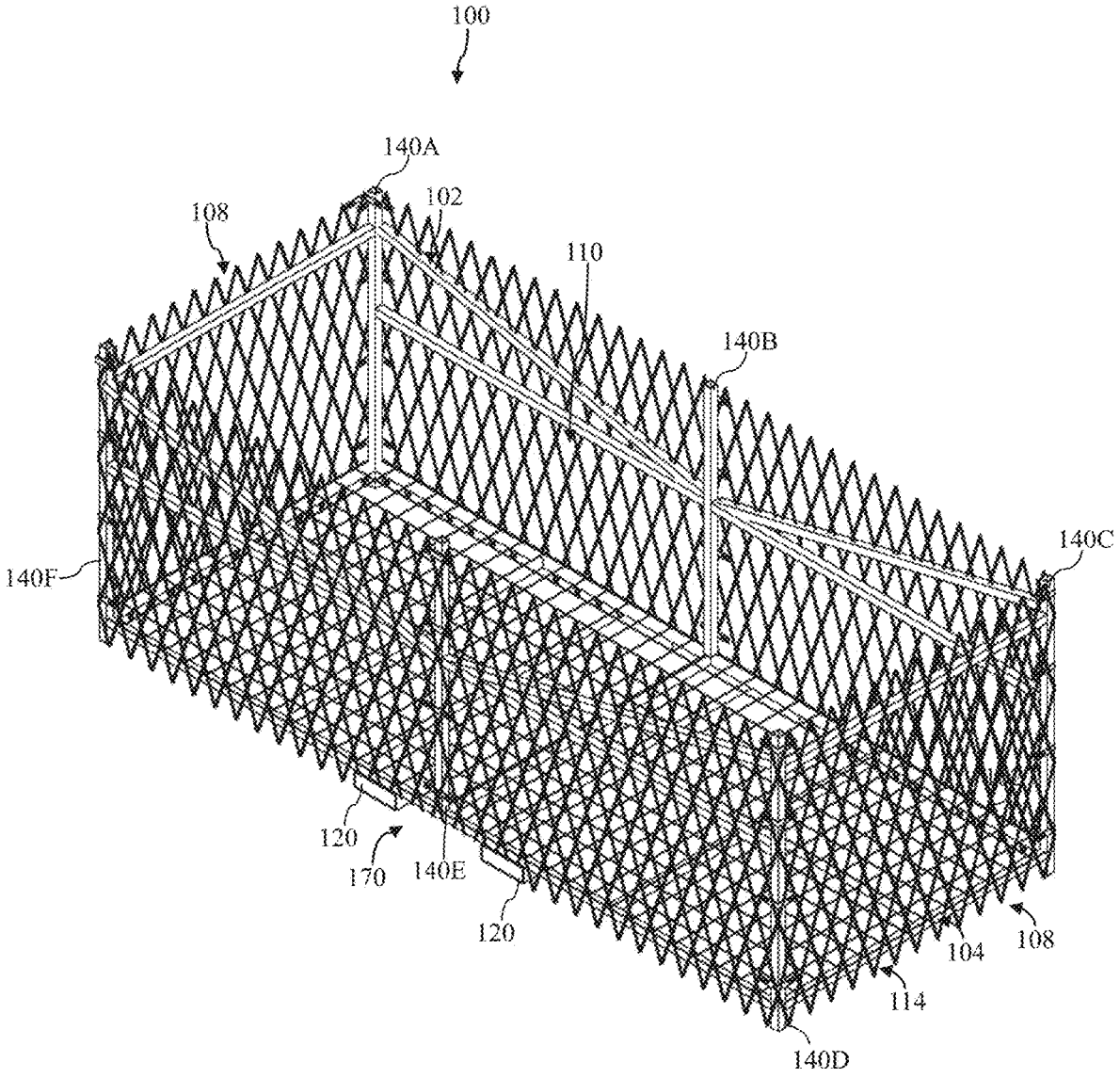
FIG. 5 is an alternative perspective view of the razor wire barrier of FIG. 1 according to exemplary approaches of the disclosure.

Turning now to FIG. 5, the barrier 100 according to embodiments of the present disclosure will be described in greater detail. As depicted, the first section of razor wire has been removed for ease of viewing the other components of the barrier 100. The barrier 100 may have a generally cuboid shape without an upper face. That is, no component may be provided over the interior area 110 to minimize the number of climbing points for the barrier 100. In the event a person was to scale one of the side walls 108, he/she would end up in the interior area 110.

In this embodiment, each of the side walls 108 is one or more panels of razor wire. For example, the second section of razor wire 114 may include a panel of razor wire extending between and coupled to two or more directly adjacent perimeter posts of the plurality of perimeter posts 140A-F. In other embodiments, one razor panel may span an entire side wall 108, e.g., extending across two (2) or three (3) perimeter posts. In other embodiments, one or more of the side walls 108 may be wire fencing, such as chain-link fencing. As is known, chain-link fencing (also known as wire netting, wire-mesh fence, chain-wire fence, cyclone fence, hurricane fence, or diamond-mesh fence) is a type of woven fence usually made from steel wire. The wires may run vertically, and are bent into a zig-zag pattern so that each "zig" hooks with the wire immediately on one side and each "zag" with the wire immediately on the other. This forms the characteristic diamond pattern seen in this type of fence. The chain-link fencing may take the place of the second section of razor wire 114, or the second section of razor wire 114 may be coupled to the chain-link fence, for example, along an outer facing side thereof. In the case one or more of the side walls 108 includes both chain-link fencing and razor wire, the two may be integrally coupled or joined together by any variety of fasteners, ties, clasps, etc.

As stated above, each of perimeter posts 140A, 140C, 140D, and 140F may extend below the floor 104, thus resting on the ground surface. The floor 104 of the frame 102 may be raised from the ground surface to permit sufficient clearance for the component receptacles 120. To minimize potential points of intrusion, however, the second section of razor wire 114 may also extend down substantially to the ground surface. The second section of razor wire 114 may include a mesh cutout 170 in an area proximate the component receptacles 120 to permit access thereto by the forklift.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

What is claimed is:

1. A portable razor wire barrier for access point security, comprising:

a frame including a floor panel having a perimeter with a plurality of sides defining corresponding sides of the frame, a plurality of perimeter posts extending upwardly from the floor panel and spaced along the perimeter thereof, at least one cross post extending between two or more perimeter posts of the plurality of perimeter posts of each side of the frame, and a plurality of walls upwardly extending from the perimeter of the floor panel, along each side thereof and defining an enclosed interior area of the barrier, wherein each of the plurality of walls comprises a planar section of razor wire coupled to the plurality of perimeter posts and to the at least one cross post, and wherein the floor panel comprises a wire fencing section extending between the plurality of walls;

a plurality of helical cons of razor wire within the interior area for preventing intrusion across the barrier, wherein the plurality of coils of razor wire are stacked atop one another and in direct contact with the floor panel of the frame; and a pair of component receptacles extending beneath and coupled to the floor panel, wherein each component receptacle is a hollow member extending entirely between a pair of opposing walls of the plurality of walls, and wherein the pair of component receptacles extends parallel to one another to receive a fork of a forklift for moving the barrier.

2. The razor wire barrier according to claim 1, wherein each of the plurality of perimeter posts extends substantially perpendicularly from the floor, and wherein the cross post is oriented substantially perpendicularly to each of the plurality of perimeter posts.

3. The razor wire barrier according to claim 1, each of the plurality of perimeter posts including at least one fastener coupled to a respective one of the planar sections of razor wire.

4. A portable razor wire barrier for access point security, the razor wire barrier comprising:

a frame including a floor panel having a perimeter with a plurality of sides defining corresponding sides of the frame, a plurality of perimeter posts extending upwardly from the floor panel and spaced along the perimeter thereof, at least one cross post extending between two or more perimeter posts of the plurality of perimeter posts of each side of the frame, and a plurality of walls upwardly extending from the perimeter of the floor panel, along each side thereof and defining an enclosed interior area of the barrier, wherein each of the plurality of walls comprises a planar section of razor wire coupled to the plurality of perimeter posts and to the at least one cross post, and wherein the floor panel comprises a wire fencing section extending between the plurality of walls;

a plurality of helical coils of razor wire disposed within the interior area for preventing intrusion across the barrier, wherein the plurality of coils of razor wire are stacked atop one another and in direct contact with the floor panel of the frame; and a pair of component receptacles extending beneath and coupled to the floor panel, the pair of component receptacles extending parallel to one another and operable to receive a fork of a forklift for moving the frame, wherein each component receptacle of the pair of component receptacles is a hollow member extending entirely between two opposite facing side walls of the plurality of side walls.

5. A portable physical access point barrier, comprising:

a frame including a floor panel having a perimeter with a plurality of sides defining corresponding sides of the frame, a plurality of perimeter posts extending upwardly from the floor panel and spaced along the perimeter thereof, at least one cross post extending between two or more perimeter posts of the plurality of perimeter posts of each side of the frame, and a plurality of walls upwardly extending from the perimeter of the floor panel, along each side thereof and defining an interior area of the barrier, wherein each of the plurality of walls comprises a planar section of razor wire coupled to the plurality of perimeter posts and to the at least one cross post, and wherein the floor panel comprises a wire fencing extending between the plurality of walls;

a plurality of helical coils of razor wire disposed within the interior area for preventing intrusion across the barrier, wherein the plurality of coils of razor wire are stacked atop one another and in direct contact with the floor panel of the frame; and a pair of component receptacles extending beneath the floor panel, the pair of component receptacles extending parallel to one another and operable to receive a fork of a forklift for moving the frame, wherein each component receptacle of the pair of component receptacles is a hollow member extending entirely between a first side of the floor panel and a second side of the floor panel.

6. The physical access point barrier according to claim 5, wherein the frame is open at a top.

7. The physical access point barrier according to claim 5, the pair of component receptacles coupled to a central area of the floor panel.

* * * * *